United States Patent [19]

Murphy

[11] 3,939,618

[45] Feb. 24, 1976

[54] FOUNDATION ASSEMBLIES FOR BUILDING STRUCTURES

[75] Inventor: Wesley T. Murphy, Auburn, N.Y.

[73] Assignee: Vercon Products, Inc., Charlotte, N.C.

[22] Filed: May 7, 1973

[21] Appl. No.: 358,193

Related U.S. Application Data

[63] Continuation-in-part of Ser. No. 160,018, July 6, 1971, abandoned, which is a continuation-in-part of Ser. No. 85,533, Oct. 30, 1970, abandoned.

[52] U.S. Cl. ..... 52/274; 52/282; 52/293

[51] Int. Cl.[2] ..... E02D 27/01

[58] Field of Search ..... 52/293, 274, 282, 234

[56] References Cited

UNITED STATES PATENTS

| | | | |
|---|---|---|---|
| 1,885,330 | 11/1932 | Cherdron et al. | 52/496 X |
| 2,054,189 | 9/1936 | Bemis | 52/481 X |
| 2,137,767 | 11/1938 | Betoone | 52/274 |
| 2,164,138 | 6/1939 | London | 52/407 |
| 2,268,907 | 1/1942 | Scott | 52/494 |
| 2,489,670 | 11/1949 | Powell, Jr. | 52/282 X |
| 2,595,633 | 5/1952 | Black | 52/656 |
| 3,170,269 | 2/1965 | Dunnington | 52/293 |

*Primary Examiner*—Alfred C. Perham

*Attorney, Agent, or Firm*—Caesar, Rivise, Bernstein & Cohen

[57] ABSTRACT

Foundation assemblies for buildings comprising sill means and a wall plate connected thereto. The wall plate serves to support a plurality of elongated half-stud members on which vertical wall panels are mounted.

In one embodiment of the invention, the sill plate is mounted directly on and connected to a concrete foundation element and comprises a sill plate and a sill locking plate. A flanged stud-tie plate is interposed between the sill locking plate and the wall plate and serves to expedite the mounting of the stud members.

In a further embodiment of the invention, the sill means is mounted on a vertically extending pier for supporting the sill plate and associated structure above the ground. In this embodiment, the sill means comprises a sill plate, a sill locking plate and a beam support angle having a portion connected to the pier and the sill plate for supporting the beam of a floor support assembly.

In another embodiment of this invention, the sill means is mounted directly on the ground and includes a channel-like mud sill and a mud plate adapted to be staked to the ground and having a resilient portion for urging the mud sill into secure engagement with the ground.

In still another embodiment of this invention, a corner bracket is provided for interconnecting two sill means and associated structural components to form a corner of the foundation assembly.

In yet another embodiment of this invention, a hollow floor support beam of a floor support assembly is mounted above the ground on a vertically extending pier. The pier is connected to the floor support assembly via a pair of interconnected beam support angles.

9 Claims, 15 Drawing Figures

2
50
26
90
32
54
58
56
48
54
50
46
64
52
2
46
50
62
42
48
60
56
44
30
50
52
112
36
22
40
110
96
28
108
38
20
34
88
98
102
24
114
60
82
84
86
104
90
62

92
27
94
56
68
50
26
45
32
4
62
52
54
72
48
70
46
64
60
96
55
42
44
30
40
49
108
36
28
82
78
38
84
86
22
34
98
88
80
24
100
102
104
5
114
60

96
174
168
45
170
172
112
108
45
101
110
108
132
98
158
126
100
102
104
45
136
128
128
146
158
159
146
159
152
156
148
126
136
136
134
158
156
150
154
154
148
152
150
146
146
124
142
142
140
144
166
144
124
140
142
138
166
142
138
158

FIG. 11
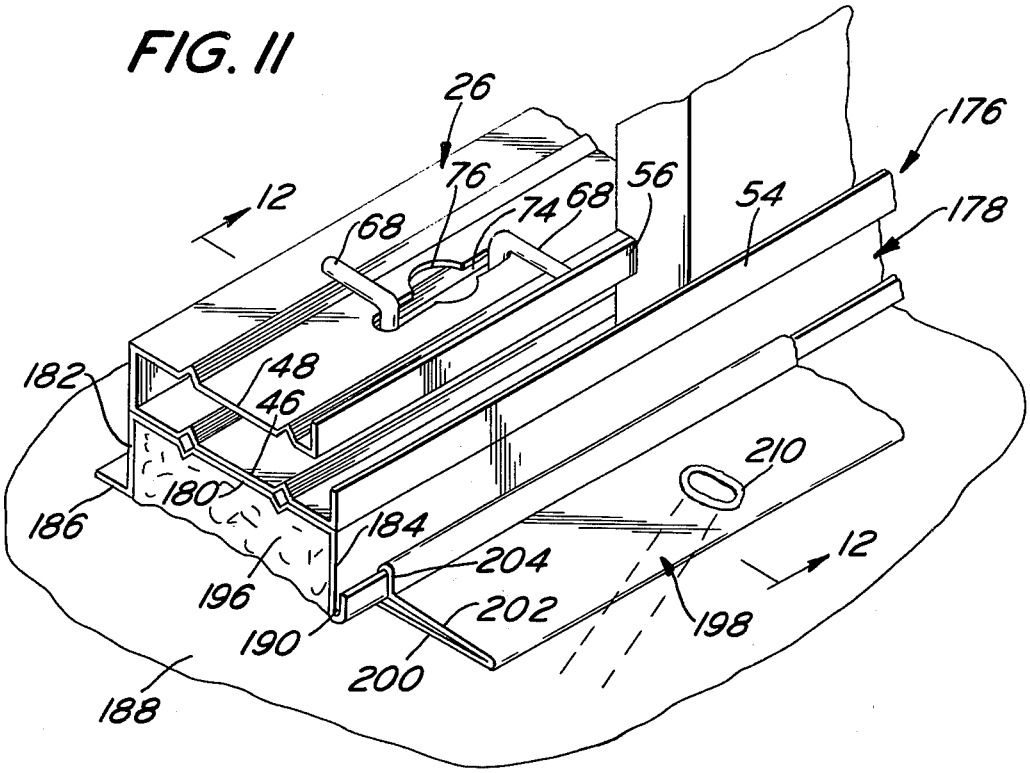
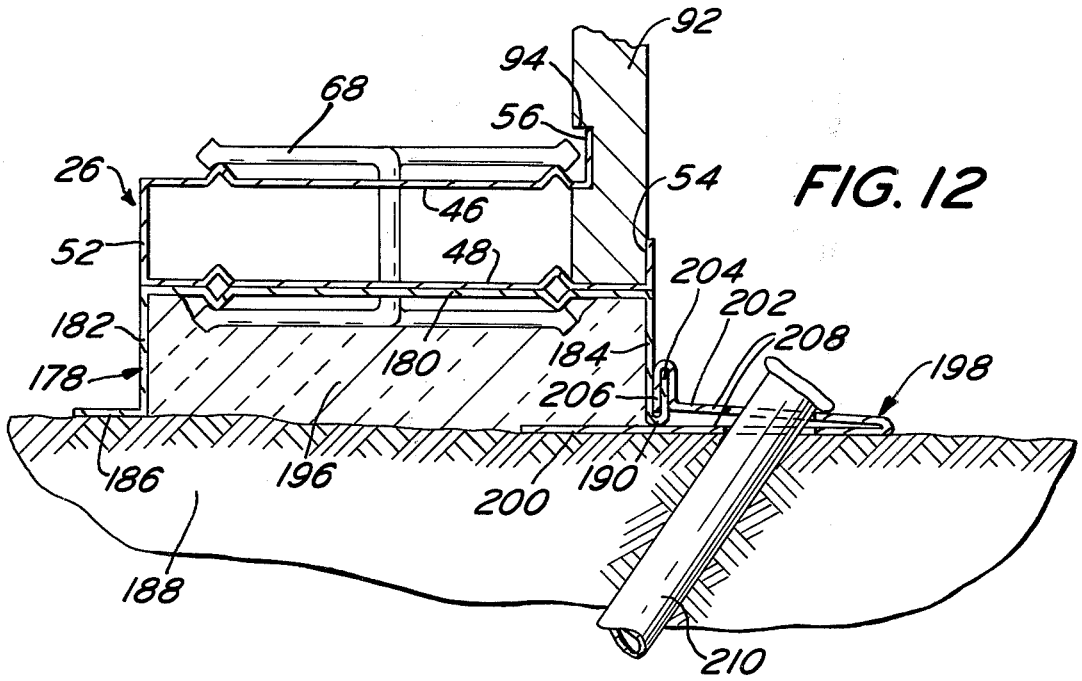
FIG. 12

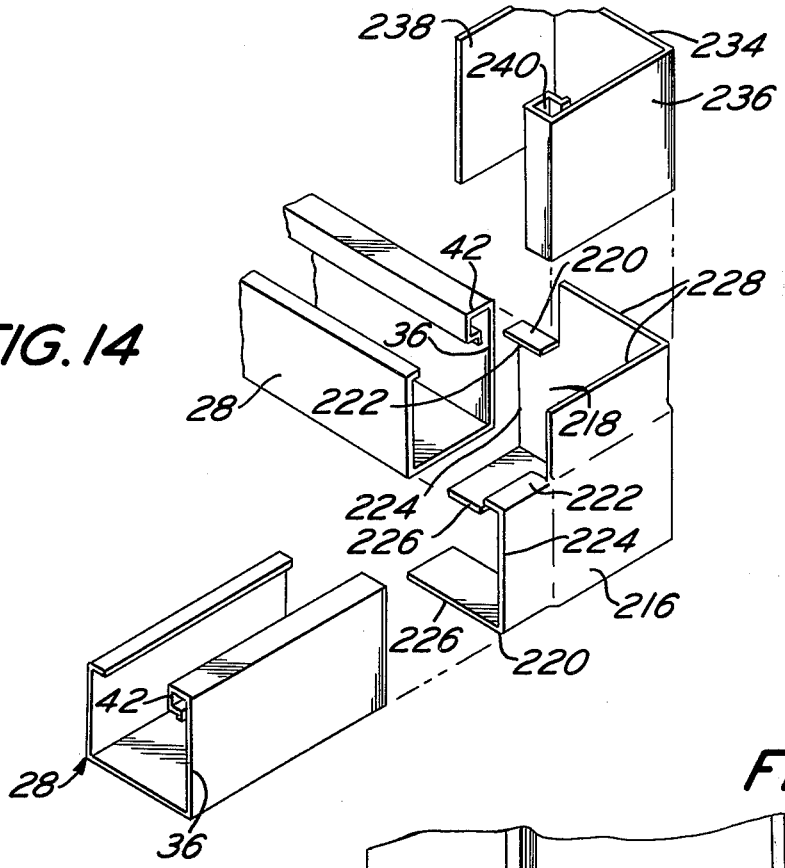
FIG. 14
FIG. 15
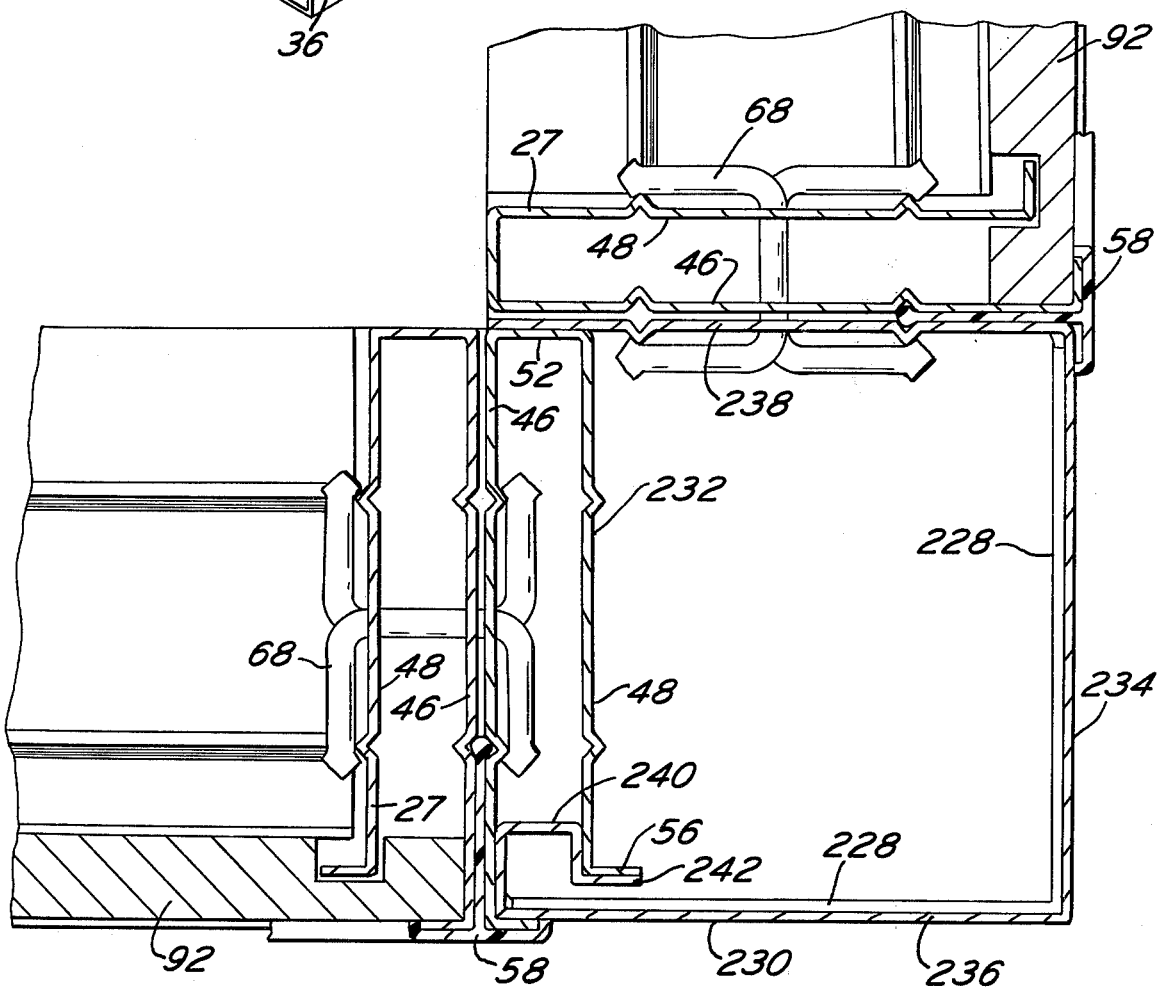

FOUNDATION ASSEMBLIES FOR BUILDING STRUCTURES

This application is a continuation-in-part of co-pending application Ser. No. 160,018 filed on July 6, 1971 and entitled "Modular Building" and now abandoned which is in turn a continuation-in-part of application Ser. No. 85,533 filed on Oct. 30, 1970 and entitled "Building Structures" and now abandoned.

The present invention relates generally to buildings and more particularly to building systems including the use of standardized foundation assemblies.

A large number of prefabricated and modular housing systems have been formulated over the years, but for various reasons, there has been little acceptance or success with such systems.

The prefabricated systems which have been presented for commerical use are generally comprised of a large number of components that are usually not standardized, and therefore must be constructed by skilled craftsman with careful attention to plans.

Furthermore, such systems have generally been unattractive in appearance, such that any saving in cost has not been proved to be an incentive to the adoption of such systems, particularly in low and middle cost housing.

As the shortage of housing grows, the need has deepened for an effective modular building that can easily be constructed by unskilled workman with standardized components and at low cost.

In the above mentioned application Ser. No. 160,018, there is disclosed and claimed novelmetal studs which are standardized and can be readily fabricated from roll steel stock when needed. The standardized studs eliminate the need for a large inventory of parts, which heretofore has been required of prior art housing systems. Furthermore, the studs are so configured as to enable a large number of parts, such as wall panels, to be readily connected without special tools by relatively unskilled labor and without the use of nails or threaded fastening means. Further still, the joints between the panels connected by the studs are not exposed and do not require spackling, tape or other retaining means. In addition to the above noted features, the stud also includes openings to permit the assembly of electrical wiring, piping, heating and ventilating ducts therethrough.

As disclosed, the studs basically comprise a pair of half-stud members held together by rotating clamps. The half-stud members are preferably of identical construction, each including a first longer wall and a second shorter wall, the first and second walls run generally parallel to each other and are connected by a bridging section. Each wall terminates in a free edge tab portion.

The two half-stud members are disposed against each other in such a way that the longer first wall of each halfstud member is immediately adjacent the other, such that the respective tabs of the first and second parallel walls extend away from each other. A vinyl separator is interposed between the adjacent first parallel walls and possesses an exterior seal at one end and an interior seal at the other end.

The walls are erected by providing an exterior panel having longitudinal grooves formed in the interior surface adjacent each vertical edge. A half-stud member is attached to the panel at each vertical edge with the tab of the second parallel wall of the first half-stud member being received in the longitudinal groove of the panel. The exterior panel with its half-studs is then so positioned with respect to a previously erected wall panel (which already has a half-stud associated therewith) so that the half-stud of the previously erected wall panel and the nearest half-stud of the panel about to be erected, may be secured together to rotating clamps after a vinyl separator has been interposed between the first parallel walls of the two half-studs.

A novel spring clip is provided to enable a half-stud member to be simply and securely fastened to a horizontal wall plate. The clip also has other fastening functions, one of which being to secure the half-stud members to a supporting brace.

The clip essentially comprises a body portion from which a tab portion extends at one end thereof, with the spring finger extending from the other end of the body portion. The clip is adapted to snap into a pair of slots that exist in adjacent walls that are to be secured together. To that end, the tab portion of the clip is simply slipped into one of the slot pairs and the spring finger is passed through the other slot pairs and allowed to move in a locking position.

In co-pending application Ser. No. 339,796, filed on Mar. 9, 1973, now Pat. No. 3,867,802 whose disclosure is incorporated herein, there is disclosed a floor support assembly for modular building systems. The floor support assembly is formed of standardized parts which can be fabricated when needed, can be put together by relatively unskilled workman without special tools and can be used to serve as heating and/or cooling ductwork.

The floor support assembly comprises a joist, a beam having a joist-supporting ledge and a locking clip for connecting the joist to the beam. The joist includes an elongated bottom wall portion and a pair of slide walls projecting along the length of the bottom wall and at an angle thereto so as to form a generally V-shaped member. Each side wall of the joist includes a ledge extending therealong. The ledges are coplanar and are adapted to be received within respective grooves in a floor panel to support the floor panel thereon.

The joist itself is supported at its end by the ledge of the beam and is connected to the beam by the clip.

The clip includes an elongated body portion, a short leg and a long leg projecting laterally from opposed ends of the body portion and in opposite direction thereto. The long leg terminates in a projecting ear. The short leg of the clip extends through an opening in the bottom wall of the joist adjacent the end and an aligned opening in the ledge disposed thereunder. The long leg of the clip extends through an opening in the side wall of the joist's flange with the projecting ear thereon extending into an opening in the beam.

The beam includes a flanged portion for connection to a similar beam to form a hollow beam section which not only serves as a support for other floor joists, but also serves as a heating and/or cooling duct.

Heretofore, various foundation assemblies for modular building systems have been proposed, but such assemblies have suffered from various deficiencies, such as for example, they require large inventory of specially fabricated parts, they are complex, they require skilled workman or special tools for assembly and are relatively expensive.

It is a general object of this invention to provide foundation assemblies which overcome the above described disadvantages of prior art foundation assemblies.

It is a further object of this invention to provide novel foundation assemblies formed of standardized components which can be fabricated when needed, and can be readily assembled by relatively unskilled workman without special tools.

It is a further object of this invention to provide a foundation assembly composed of standardized components and adapted for mounting a building structure directly upon a concrete foundation.

It is yet a further object of this invention to provide a foundation assembly composed of standardized components and adapted for mounting a building structure on piers above the ground.

It is still a further object of this invention to provide a foundation assembly composed of standardized components and adapted for mounting a building structure directly on the ground.

These and other objects of this invention are achieved by providing a foundation assembly for a building. The assembly comprises still means and a wall plate connected to the sill means. The wall plate comprises a first longer wall disposed generally parallel to and immediately adjacent to the sill means and a second shorter wall. The first and second walls of the wall plate run generally parallel to one another and are connected by a bridging section. Each wall of the wall plate terminates in a vertical free edge tab which defines a space therebetween into which the edge of a vertical wall panel is disposed.

In one embodiment of the invention, the sill means is mounted directly on and is connected to a concrete foundation element.

In another embodiment of the invention, the sill means is mounted above the ground on a vertically extending pier.

In yet another embodiment of this invention, the sill means is mounted directly on and is connected to the ground.

In still another embodiment of the invention, a corner assembly is provided for connecting two sill means and the components associated therewith to form a building foundation corner.

Other objects and many of the attendant advantages of this invention will be readily appreciated as the same becomes better understood by reference to the following detailed description when considered in connection with the accompanying drawings wherein:

FIG. 11 is a perspective view, partially in section, of another embodiment of a foundation assembly in accordance with this invention;

FIG. 12 is an enlarged sectional view taken along line 12—12 of FIG. 11;

FIG. 14 is an exploded perspective view of a portion of the assembly shown in FIG. 13; and FIG. 15 is an enlarged sectional view taken along line 15—15 of FIG. 13.

Referring now in greater detail to the various figures of the drawing wherein like reference characters refer to like parts, a building foundation assembly in accordance with one aspect of this invention is shown generally at 20 in FIG. 1.

Figure 1:
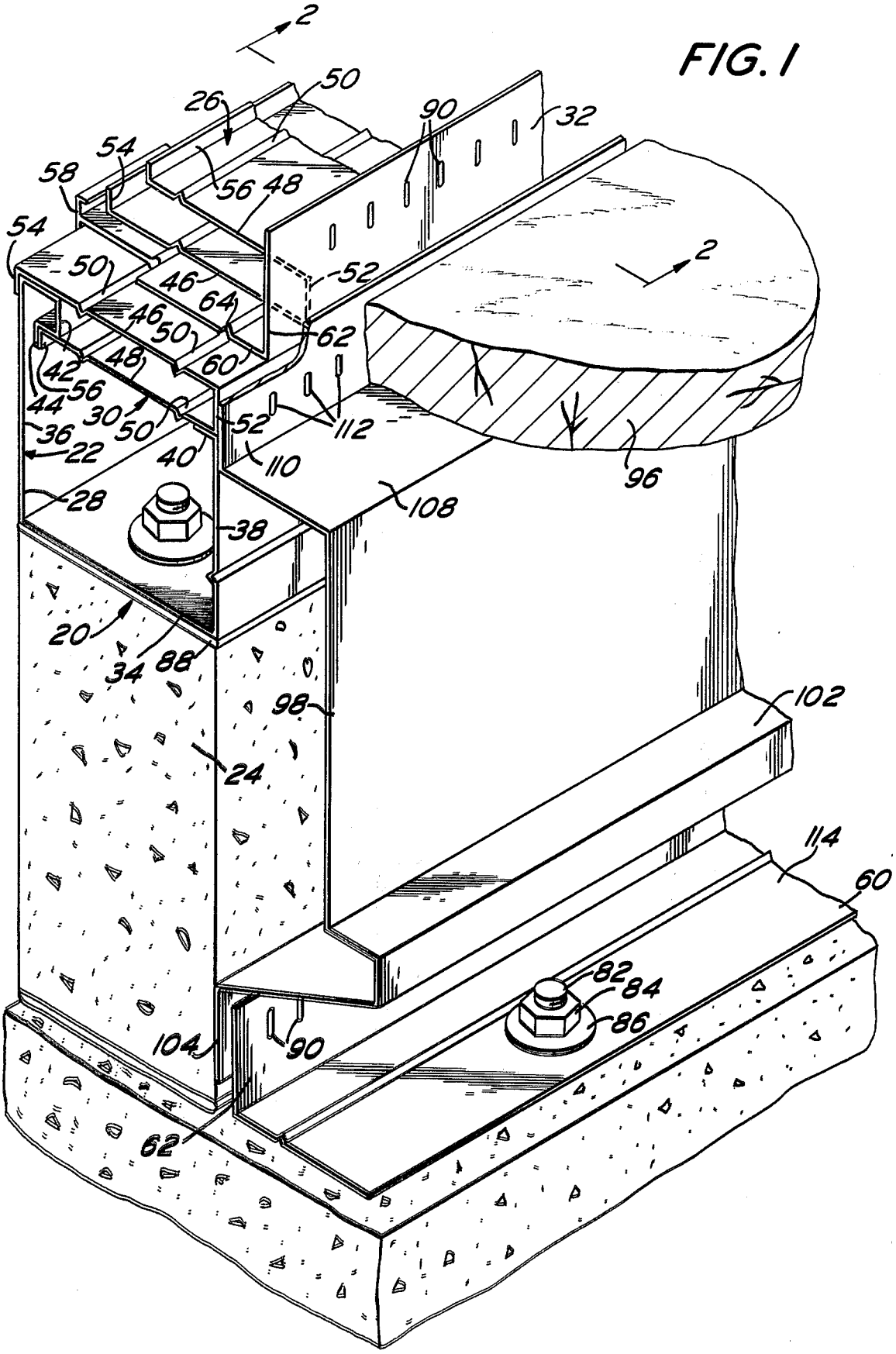
FIG. 1 is a perspective view, partially in section, of one embodiment of a foundation assembly in accordance with this invention.

Assembly 20 basically comprises a sill assembly 22 which is mounted directly on a concrete foundation 24 of a building structure and which supports a wall plate 26 thereon. The wall plate is in turn adapted to support vertical half-studs member 27 (see FIG. 2), like those disclosed in the above noted co-pending application Ser. Nos. 85,533 and 160,018. Two half-studs are interconnected together to form a vertical stud to which wall panels are connected.

The sill assembly comprises a sill plate 28 and a sill locking plate 30. A stud-tie plate is connected to the sill assembly and serves as a means for connecting the half-studs to the wall plate.

In accordance with a preferred aspect of this invention, the individual components forming foundation assembly 20 are formed of roll steel stock, such as 20 gauge roll steel stock, and can be readily fabricated when needed.

This feature is of considerable importance in the housing construction industry where heretofore the maintenance of large inventories was required in order to permit the construction of buildings from standard-type parts. Needless to say, such large parts inventories result in increased overall building costs due to the increased storage and handling costs attendant with such inventories. Furthermore, by eliminating large inventories, the problem of having surplus parts left over once the building is completed, is minimized, if not eliminated.

Figure 2:
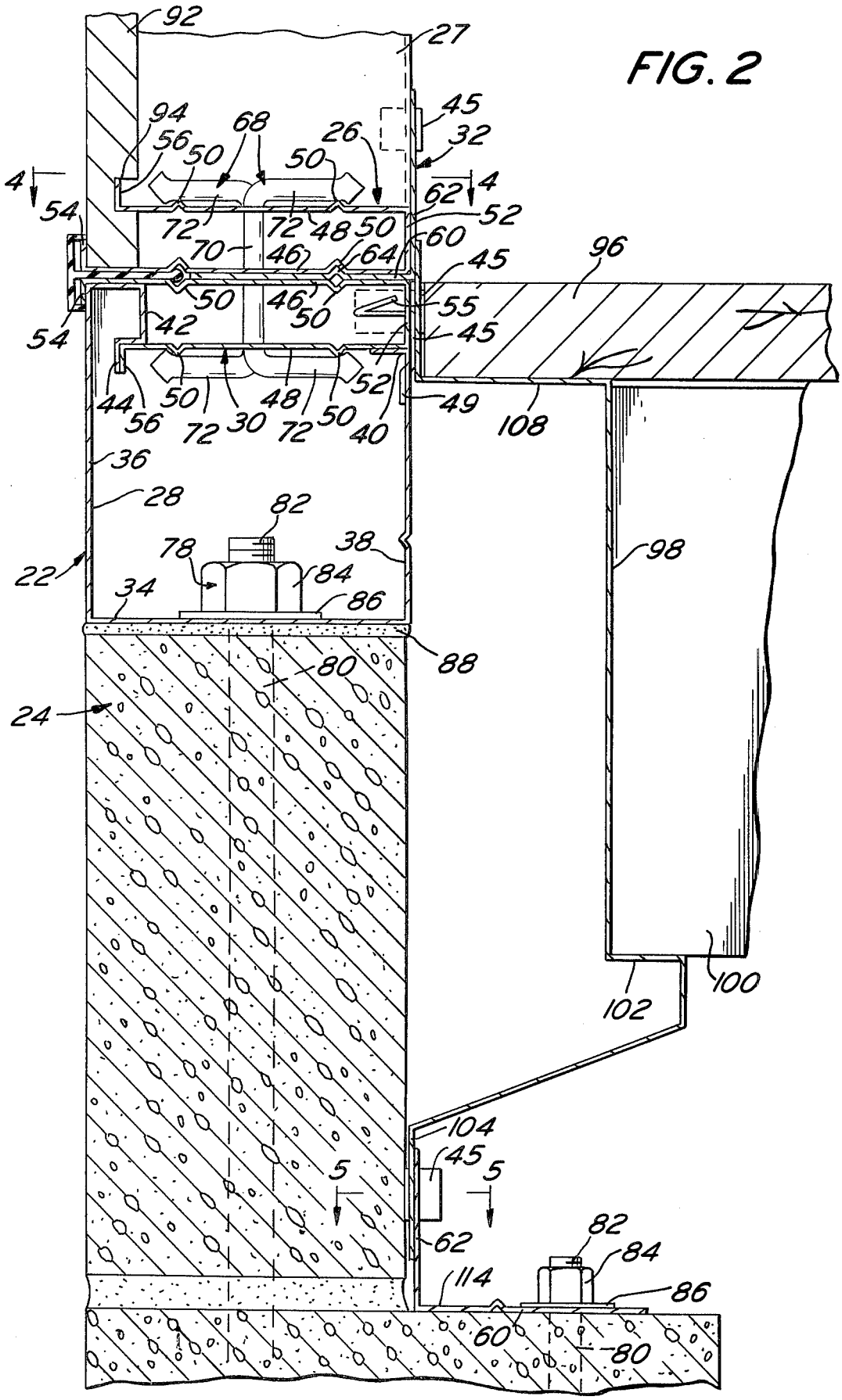
FIG. 2 is a sectional view taken along line 2—2 of FIG. 1.

As can be seen in FIGS. 1 and 2, the sill plate 28 is a three-sided or generally C-shaped member and comprises a base 34 and a pair of walls 36 and 38 projecting upward normally therefrom. Wall 38 is of shorter height than wall 36 and terminates at its free end in a free edge tab 40 which projects inward and normal to the plane of wall 38. The free end of wall 36 is bent back over itself into a generally rectangular shape to form a short, thick ledge 42. The ledge 42 is hollow and terminates at its end in a downwardly extending stop 44.

Figure 5:
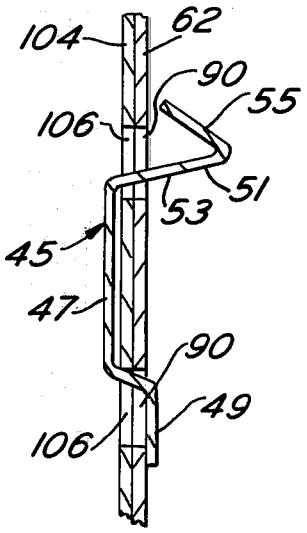
FIG. 5 is an enlarged sectional view taken along line 5—5 of FIG. 2.

The wall 38 of the sill plate 28 includes a plurality of aligned longitudinal slots (not shown). The bridging section 52 of the sill locking plate also includes a plurality of aligned longitudinal slots (not shown) as well as a plurality of transverse slots (not shown). The longitudinal slots in the sill plate and the sill locking plate serve as means for effecting the connection of those plates to one another to thereby complete the sill assembly. To that end, plural spring clips 45, like that described in above noted application Ser. No. 160,018 are inserted in associated aligned slots. The clips 45 are constructed of spring steel and, as can be seen in FIG. 5, essentially comprise a body portion 47 from which a tab portion 49 extends at one end thereof with a spring finger 51 extending at the other end of the body portion. The spring finger is essentially V-shaped and consists of an intermediate web 53 terminating in a free tab 55 which can be resiliently urged towards and away from the intermediate web 53.

The insertion of the clip 45 in the aligned longitudinal slots is accomplished by slipping the tab portion into a sill plate slot. The clip is then rotated toward the aligned sill locking plate slot and the spring finger is inserted therein. This causes the spring finger to be compressed. When the free tab 55 of the spring finger 51 clears through the sill locking plate slot, the free tab immediately springs away from the intermediate web to return to its original position and thereby lock the clip in place.

The sill locking plate 30 is of the same shape as the half-stud members shown and described in application Ser. No. 160,018 and comprises a first longer wall 46 and a second shorter wall 48, with the walls 46 and 48 being generally parallel to each other and possessing longitudinal crimps 50 for locking and strengthening purposes. The walls 46 and 48 are joined together by bridging section 52 and terminate in free edge tabs 54 and 56, respectively, which define a space therebetween.

The sill locking plate is connected to the sill plate to form the sill assembly 22 by inserting the ledge 42 of the sill plate into the space between the free edge tabs 54 and 56 of the sill locking plate such that a portion of the short wall 48 of the sill locking plate rests on tab 40 and tab 56 abuts stop 44.

The wall plate 26 is of identical construction to the sill locking plate 30 and thus the component portions of the wall plate have the same reference numerals as the corresponding portions of the sill locking plate.

From FIGS. 1 and 2, it will be seen that the wall plate 26 is mounted on the sill plate 30 with the longer wall 46 thereof disposed on top of the corresponding wall of the sill locking plate. A vinyl separator 58, of generally T-shaped cross section is interposed between the adjacent longer wall in an abutting relationship therewith, to provide a weatherproof seal between the wall plate and the sill assembly.

The stud-tie plate 32 is an elongated member comprising a base portion 60 and a flanged portion 62 projecting normally therefrom. The base portion includes an opening (not shown) and a longitudinal crimp 64 for locking and strengthening purposes. The flanged portion 62 includes a plurality of transverse slots 66 for connecting the vertical half-stud members thereto.

Figure 4:
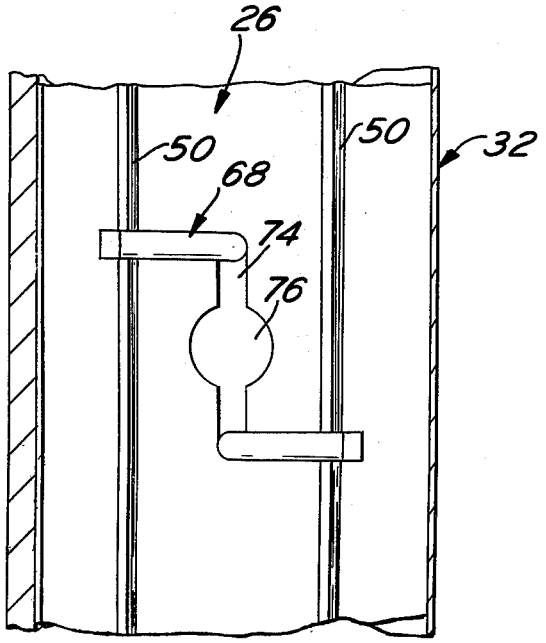
FIG. 4 is a sectional view taken along line 4—4 of FIG. 2.

The wall plate 26 and sill locking plate 30, together with the interposed vinyl separator 58 and the base 60 of the stud-tie plate 32 are secured together by means of rotating clamps 68 like that shown and described in application Ser. No. 160,018. The clamps 68 are basically U-shaped and are comprised of a base 70 and a pair of legs 72. The rotating clamp 68 is inserted through aligned slots 74 in the walls of the wall plate and the sill locking plate and the interposed flange of the stud-tie plate. The slots 74 have enlarged central portions 76 (see FIG. 4) so that the legs 72 of the clamp 68 are in actual contact with a crimp 50 in each of the shorter walls 48 of the wall plate and sill locking plate.

The insertion of the rotating clamp 68 is usually done in such a manner that the legs 72 are passed through the narrow portions of the slot 74 in each of the walls 46 and 48. The clamp 68 is then rotated about base 70 so that its legs are rotated away from the slot. The legs are so dimensioned and spaced with respect to each other as to be separated by a distance slightly less than the distance between convex crimps 50 in the parallel short walls 48 of the wall plate and sill locking plate. Thus, as the clamp 68 is rotated as described above, the legs 72 exert an inward force upon by the shorter walls 48, thereby firmly uniting wall plate 26 and sill locking plate 30 along with the interposed vinyl separator 58 and the base 60 of the stud-tie plate 32.

In actual practice, it is preferred that two rotating clamps 68 be used for each connection.

The sill assembly 22 is mounted directly on a concrete foundation 24 and is connected thereto via releasable fastening means 78. The concrete foundation may have a base with side walls projecting therefrom, as is the case in the embodiment of FIGS. 1 and 2, or may merely be a flat pad, as is the case in the embodiment of FIG. 3. Preferably, the releasable fastening means 78 comprise an elongated tie bolt 80 extending through a hole in the foundation 24 and having a threaded end 82 extending through a hole (not shown) in the base 34 of the sill plate. A nut 84 and associated washer 86 is screwed onto the threaded end of the tie bolt. A layer of mortar 88 is interposed between the foundation and the base 34 of the sill assembly to complete the securement of the sill assembly to the foundation.

The lower ends of the wall-supporting half-studs 27 are disposed on the short wall 48 of the wall plate 26 and are connected thereto via the stud-tie plate 32. To that end, the flange 62 of the stud-tie plate includes a plurality of longitudinally aligned, transverse slots 90 (see FIG. 1) which align with respective longitudinal slots in the lower end of the bridging section 52 of the half-studs 27. Locking clips 45 are inserted through the aligned slots in the same manner as previously described to complete the connection of the studs to the wall plate.

The exterior walls of the building structure comprise plural vertical panels 92, preferably formed of plywood. The panels include a lower edge portion having a longitudinal groove 94 in the inner face thereof. The groove 94 serves as a means for effecting the mounting of the panel to the sill assembly 22 and the associated vertical half-stud 27. To that end, as can be seen in FIG. 2, the wall panel 92 is disposed in such a manner that the lower edge portion thereof is disposed within the space defined between the free edge tabs 54 and 56 of the wall plate 26, with the free edge tab 56 thereof being disposed within groove 94 in the wall panel. The panel is connected to the half-stud 27 in the same manner as described in application Ser. No. 160,018.

The floor 96 of the building structure is supported by the floor support assembly disclosed in application Ser. No. 339,796. As previously noted, the floor support assembly basically comprises a ledge beam 98 (see FIG. 1) and a floor joist 100 (see FIG. 2) supported on the ledge beam and connected thereto by a locking clip 101 (see FIG. 9).

As can be seen in FIGS. 1 and 2, the ledge beam 98 is an elongated member and includes a normally projecting lower ledge 102 which serves as the means for supporting the joist 100 thereon. The bottom of the ledge beam terminates in a lower flange 104 having a plurality of slots 106 therein (see FIG. 6). The beam also includes an upper ledge 108 which is parallel to the lower ledge 102 and extends in the opposite direction thereto. The upper ledge aids the joist in supporting a floor panel of the floor 96 and terminates in an upper flange 110 having a plurality of transverse slots 112 therein. The upper flange is coplanar with the lower flange.

The floor support assembly is mounted on the foundation assembly 20 by connecting the upper flange of the ledge beam to the sill assembly 22 and the lower flange of the ledge beam to the foundation 24. To that end, plural locking clips 45 are inserted through slots 112 in the upper flange of the ledge beam and through aligned transverse slots (not shown) in the bridging section 52 of the sill locking plate 30. The lower flange of the ledge beam is connected to the foundation 24 via a beam mounting angle 114. The beam mounting angle is of identical construction as the stud-tie plate 32 and includes a base portion 60 and a flanged portion 62 projecting normally therefrom. The base portion is disposed on the foundation and includes an opening through which the threaded end 82 of a tie rod 80 extends. A nut 84 and associated washer 86 are screwed onto the threaded end 82 of the tie rod to securely connect the base of the beam mounting angle 114 to the foundation 24. The flange of the beam mounting angle 114 includes a plurality of longitudinally aligned transverse slots 90. The slots 90 align with slots 106 in the lower flange of the ledge beam 98. A plurality of locking clips are inserted in the aligned slots 90 and 112 to secure the ledge beam to the beam mounting angle and thus to the foundation.

By mounting the floor support assembly on the foundation assembly 20 as shown in FIGS. 1 and 2 and by mounting the foundation assembly on the vertical wall of a concrete foundation, a basement or a crawl-space is provided in the building structure between the pad of the foundation and the floor support assembly.

Figure 3:
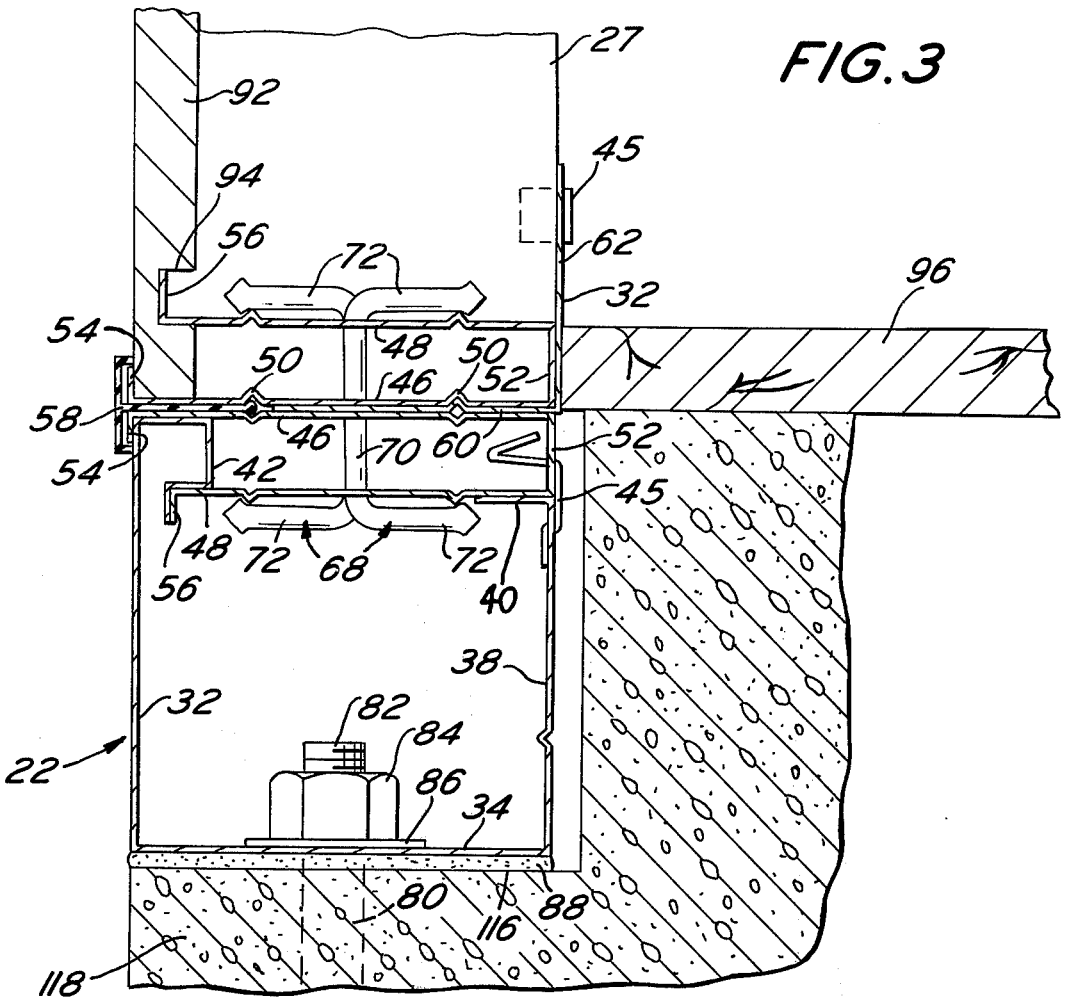
FIG. 3 is a sectional view of another embodiment of a foundation assembly in accordance with this invention.

In FIG. 3 there is shown the manner in which a foundation assembly in accordance with this invention is mounted on a flat foundation pad to form a building structure not having a basement or a crawl-space. As can be seen therein, the sill assembly 20 and associated components are mounted within a recess 116 in a flat concrete foundation pad 118. The sill assembly 22, the wall plate 26 and associated wall panel mounting components are arranged and connected to one another and to the pad in the same manner as that shown in FIGS. 1 and 2. The panels forming the floor 96 of the building structure are mounted directly on the concrete pad, thereby obviating the need for the floor support assembly and the associated components shown in FIG. 1.

Figure 6:
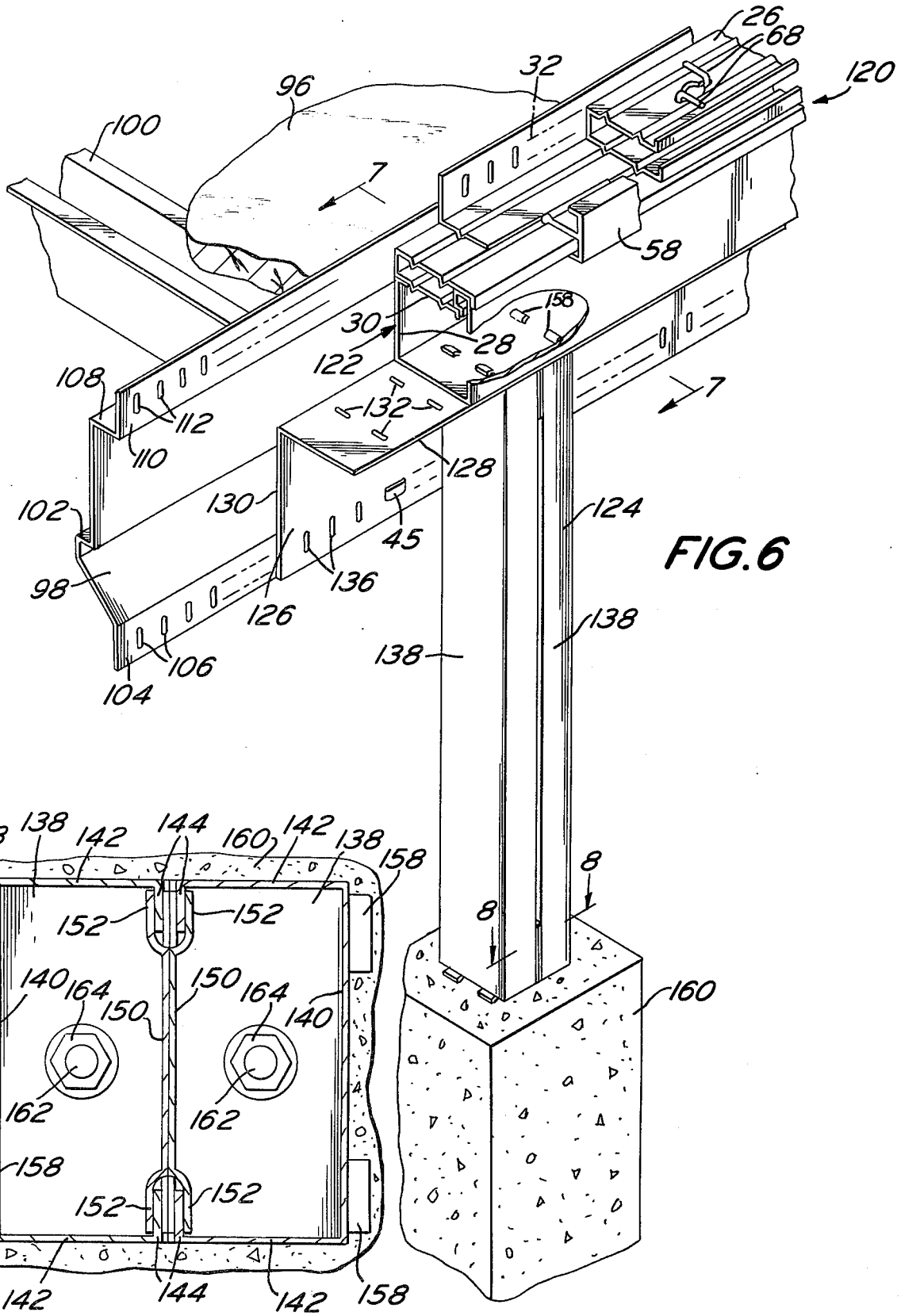
FIG. 6 is another embodiment of a foundation assembly in accordance with this invention.

In FIG. 6 there is shown another foundation assembly 120 in accordance with this invention. Assembly 120 is designed for supporting a building structure above the ground on piers or posts. As can be seen, assembly 120 basically comprises a sill assembly 122 which is mounted above the ground on a vertically extending pier or post 124. Like the sill assembly 22 in the foundation assembly 20, the sill assembly 122 in foundation assembly 120 is adapted for mounting and supporting thereon a wall plate 26 and associated panel-mounting half-stud members 27. Furthermore, foundation assembly 120 is adapted for supporting a floor support assembly thereon.

In accordance with the preferred aspect of this invention, the individual components forming foundation assembly 120 are formed of roll steel stock, such as 20 gauge roll steel stock, and can be readily fabricated when needed.

Figure 7:
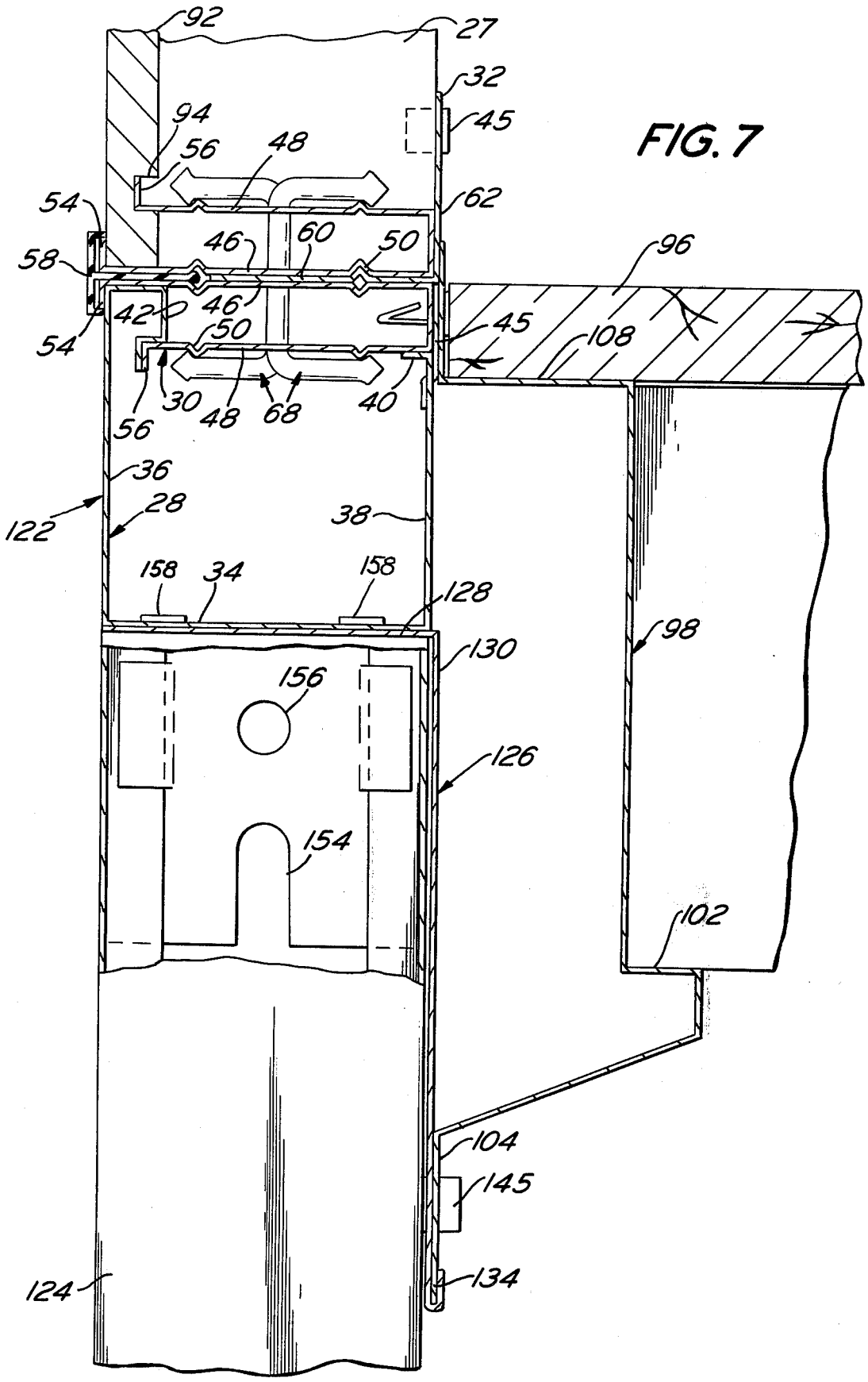
FIG. 7 is an enlarged sectional view taken along line 7—7 of FIG. 6.

As can be seen in FIGS. 6 and 7, the sill assembly 122 basically comprises a sill plate 28, a sill locking plate 30, both of which being identical to the corresponding plates of assembly 22, and a beam support angle 126. The sill locking plate is connected to the sill plate by inserting the ledge 42 of the sill plate into the space between the tabs 54 and 56 of the sill locking plate with a portion of the short wall 48 of the sill locking plate resting on tab 40 and with free edge tab 56 abutting stop 44. A plurality of spring clips 45 are inserted in associated aligned slots in the sill plate and the sill locking plate to complete the connection therebetween.

A generally T-shaped vinyl separator 58 and the base 60 of a stud-tie plate 32 are interposed between the longer wall of the sill locking plate and the corresponding wall of the wall plate and the plates are connected together via rotatable clamp 68.

The beam support angle is an elongated member and comprises a base portion 128 and a flanged portion 130 projecting normally therefrom. The base portion includes two longitudinal rows of transversely extending slots 132. The slots 132 are aligned with similar slots (not shown) in the base 34 of the sill plate 28 and serve as the means for connecting the beam support angle to the sill plate and for mounting the sill assembly on the pier 124 in a manner to be described in detail later.

The flange 130 of the beam support angle terminates at its free edge in a groove 134 (FIG. 7) which is formed by bending the free edge back over itself. A plurality of longitudinally aligned transverse slots 136 are provided in the flange 130 adjacent the free edge groove 134.

The free edge groove 134 and the slots 136 in the associated flange serve as the means for supporting the ledge beam 90 of a floor support assembly. To that end, the lower flange 104 of the ledge beam 98 is disposed within the groove 134 in the beam support angle with the slots in the beam aligned with the slots 136 of the beam support angle. A plurality of locking clips 145 are inserted in the aligned slots to complete the connection therebetween. The upper flange 106 is connected to the sill locking plate in the same manner as that described with reference to the foundation assembly 20.

Figure 8:
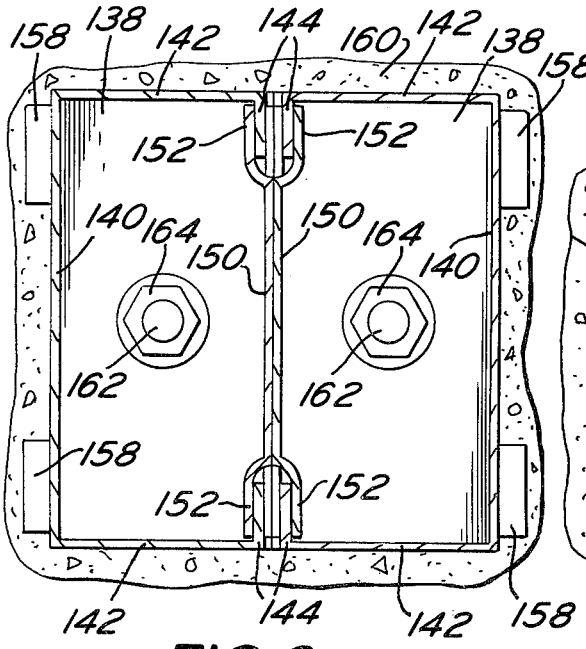
FIG. 8 is an enlarged sectional view taken along line 8—8 of FIG. 6.
Figures 9, 10:
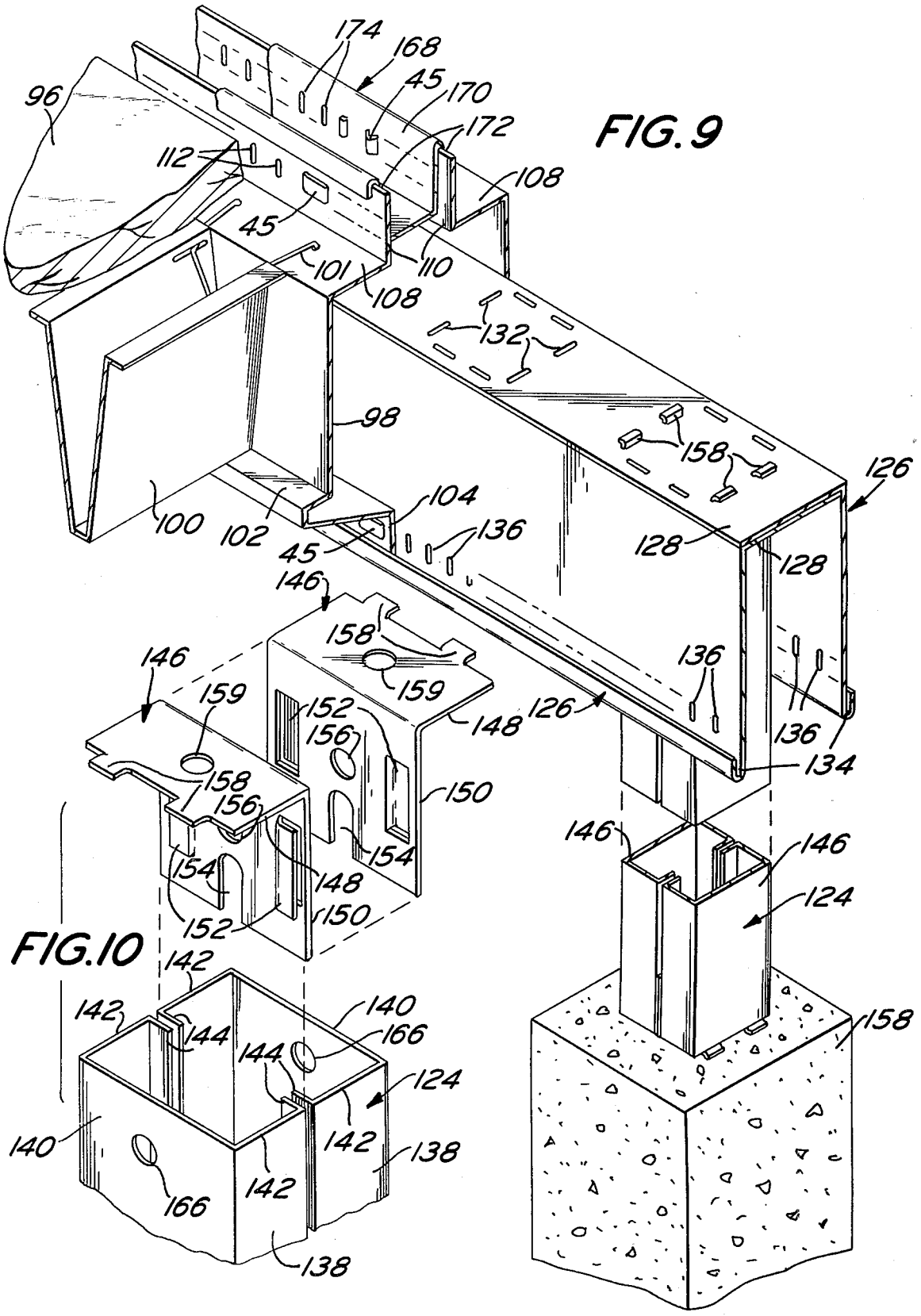
FIG. 9 is a perspective view, partially in section, of another embodiment of a foundation assembly in accordance with this invention.
FIG. 10 is an enlarged, exploded perspective view of a portion of the assembly shown in FIG. 6.

The construction of pier 124 can best be seen in FIGS. 8 and 10. As can be seen, pier 124 comprises a pair of identical elongated channel-like members 138. Each member includes a base 140 and a pair of side walls 142 projecting therefrom. The side walls each terminate in a tab 144 projecting normally to the plane thereof and toward one another. The channel-like members 138 are disposed adjacent each other with the tabs of the side wall of one member aligned with the corresponding tabs of the side walls of the other member.

A pair of angle brackets 146 are provided to aid in the connection of the channel-like members 138 to one another and to connect the pier 134 formed thereby to either a sill assembly or to a concrete foundation element such as a pier footing. The angle brackets are identical and each comprises a base portion 148 and a flanged portion 150 extending normally therefrom. Each flange includes a pair of ears 152 which are bent out of the plane of the flange and which lie in a common plane parallel to the plane of the flange. Each ear and the flange from which it is offset define a space therebetween into which a respective tab of one of the channel-like members 138 is disposed to connect the angle bracket thereto.

An elongated groove 154 is provided in the free edge of the flange at its midpoint. An anchor hole 156 is provided slightly above the groove 154 for purposes to be described later. A pair of projections or tabs 158 extend from the free edge of the angle bracket's base. The tabs serve as the means for connecting the brackets to other structural members such as the beam support angle 126 and the sill assembly 122.

A mounting hole 159 is provided in the midsection of the base of each angle bracket and serves as a means for mounting the bracket on a concrete foundation element, such as footing 160.

As can be seen in FIG. 8, the lower end of pier 124 is held together in the following manner: A pair of angle brackets 146 are mounted abutting to one another on a concrete footing 160 and each is connected thereto via a bolt 162 and associated nut 164 extending through the mounting hole 156 in the base of the bracket. The tab of each side wall of each channel-like member is disposed within the space defined between the associated ear 152 and the flange 150 from which it is offset.

By virtue of the securement of the angle bracket to the concrete footing, the channel-like members forming the pier are precluded from separating laterally. An anchor hole 166 is provided in the base of each channel-like member. The anchor holes are aligned with the holes 156 in the bracket's flange and an anchor bolt (not shown) extends therethrough to preclude the tabs of the channel-like members from sliding longitudinally with respect to the brackets and thereby secures the brackets to the pier 124.

The upper end of the pier 124 is held together in the following manner: A pair of angle brackets 146 are mounted on the respective upper ends of the pier with the tabs of the pier's channel-like members disposed within the space defined between the ears and flanges from which the ears are offset. An anchor bolt (not shown) extends through anchor holes 166 in the base of the channel-like member adjacent the upper end thereof and through the aligned holes 156 in the pair of angle brackets. This secures the brackets to the pier 134 at the upper end thereof.

The tabs 158 at the edge of the base of each angle bracket extend through the slots 132 in the beam support angle 126 and the aligned slots (not shown) in the base 34 of the sill plate 28. Once extended through the aligned slots, the tabs 158 are bent downward toward the base of the sill plate to effect the securement of the sill assembly 122 to the pier 134.

FIG. 9 shows the direct mounting of a pair of floor support assemblies on a vertical pier 124 without utilizing the foundation assembly 120 shown in FIGS. 6 and 7.

As can be seen, two ledge beams 98 are connected together at their upper flanges 110 by a generally U-shaped elongated beam spacer 168. The beam spacer includes a pair of side walls 160, each of which terminates in a flanged edge forming a channel 172 therein. The channels 172 are adapted for receiving and holding the upper flange 110 of a ledge beam 98. The beam spacers include a plurality of transverse slots 174 in the side walls 170.

When the beam's flanges are disposed within the associated channels 172 in the interposed beam spacer 170, with the slots 112 therein aligned with the slots 174 in the beam spacer, a plurality of clips 145 are inserted into the aligned slots to secure the beams together.

The lower edge of the two ledge beams 98 are connected together and are connected to the top of a pier 124 via a pair of interconnected beam support angles 126. The pier 124 and the individual beam support angles 126 are constructed in the same manner as previously described.

As can be seen, the beam support angles are placed on top of one another with their base portions 128 abutting one another and with the slots 132 therein aligned. When arranged in this manner, the beam support angles form a generally U-shaped member having a pair of side walls, each of which terminates in a flanged edge forming a channel or groove 134 therein. Each channel is adapted for receiving and holding the lower flange 104 of a ledge beam with the slots 106 therein aligned with the slots 136 in the beam support angle. A plurality of locking clips 45 are provided in the aligned slots to connect the ledge beam to the beam support angle.

The interconnected beam support angles are mounted on the top of the pier 124 and are connected thereto via the tabs 158 of the angle brackets 146 extending through the aligned slots 132 in the same manner as described with reference to FIG. 6.

In FIG. 11 there is shown another foundation assembly 176 in accordance with this invention. The assembly 176 is adapted to be mounted directly on the ground without the use of any concrete foundation.

As can be seen, assembly 176 basically comprises a mud sill 178 which is formed as an elongated channel-like member having a base portion 180 and a pair of side walls 182 and 184, respectively, projecting therefrom. The side wall 182 terminates in a free edge tab 186 extending normally to the plane of the side wall. Tab 186 is adapted to be disposed directly on the ground 188. The other side wall 184 terminates at its free edge in a groove 190 formed by the side wall being bent back over itself. Slots (not shown) each having an enlarged central opening are provided in the base of the mud sill for receipt of a rotatable clamp 68. Insulation 196, such as polyurethane foam, is disposed within the mud sill between the base and the ground 188.

The mud sill is secured in place on the ground by a mud plate 198. The mud plate comprises a flat base 200 disposed on the ground and an extension 202 of the base bent back over itself at a bend line and disposed at a slight angle to the base 200. The extension 202 of the base is resilient and adapted to flex about the baseline. The extension terminates at its free end in a locking groove 204 having a downward extending outer wall 206.

The mud plate is disposed such that its base extends under the side wall 184 with the outer wall 206 of the locking groove disposed within the groove 190 therein and with the outer edge of the side wall disposed within groove 204.

A pair of aligned holes 208 are provided in the base and the base extension of the mud sill. A stake, such as a pipe 210, is disposed within the aligned holes and is hammered into the ground, whereupon the top edge of the stake deforms to form an enlarged head. Upon a stake being driven fully into the ground, the enlarged head thereof abuts the portion of the base extension contiguous with the hole therein, thereby causing the extension to flex downward and to apply a force through the interlocked grooves to the mud sill. This action holds the mud sill securely in place.

A wall plate 26, like that previously described, is connected to the mud sill by disposing its long wall 46 on the base 200 of the mud sill with the slots 74 in the wall plate aligned with the slots (not shown) in the mud sill. Rotating clamps 68 are inserted in the aligned slots to effect the securement of the wall plate to the mud sill.

Vertical wall panels 92 are supported on the wall plate by disposing the lower edge of the wall panel within the space defined between the free edge tabs 54 and 56 of the wall plate and with the free edge tab 56 disposed within groove 94 in the wall panel. Half-studs (not shown) like those described previously are mounted in the wall plate and serve to support the wall panel vertically.

Figure 13:
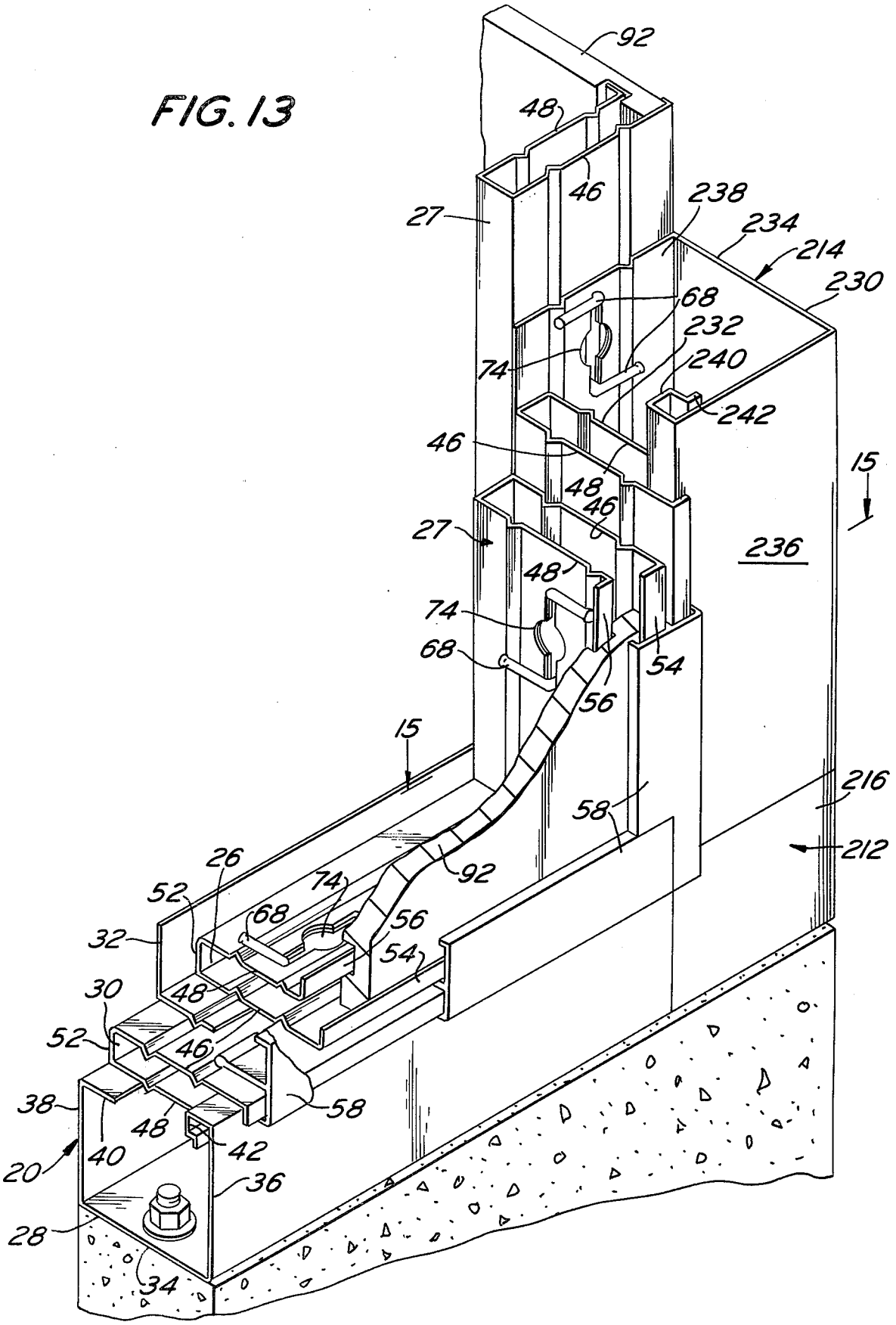
FIG. 13 is a perspective view, partially in section, of a foundation assembly corner in accordance with this invention.

In FIG. 13 there is shown the corner of a building structure wherein two foundation assemblies 20 (only one of which can be seen), forming the support for a pair of mutually perpendicular walls 92, are interconnected by a sill corner bracket 212. The sill corner bracket also serves to support a corner section 214, which is constructed in a manner as disclosed in application Ser. No. 160,018 and which in turn serves to interconnect a half-stud 27 supporting one wall panel and a corresponding half-stud supporting the other panel.

Each foundation assembly and the structural components supported thereby and associated therewith is constructed and arranged in the same manner as that described with reference to FIGS. 1 and 2.

In the exploded respective view of FIG. 14, there is shown the details of the sill corner bracket 212. As can be seen, the sill corner bracket comprises a pair of perpendicular outer walls 216 and 218. Each wall includes a side from which a generally C-shaped extension 220 is offset. The extension comprises three flanged inserts, a short-walled, horizontal top insert 222, a long-walled, vertical side insert 224 and a long-walled horizontal bottom insert 226. The inserts serve as the means for connecting the sill plate of the sill assembly to the corner bracket. To that end, the top insert 222 is adapted to be frictionally disposed within the hollow portion of the short, thick ledge 42 of the adjacent sill plate 28. The side insert 224 is adapted to be frictionally disposed within the sill plate and abutting the inner surface of the side wall 36 thereof. The bottom insert 226 is also adapted to be frictionally disposed within the sill plate but in abuttment with the inner surface of the base 34 thereof.

The flanged insert 224 is offset from the plane of the outer wall from which it extends by a sufficient distance such that when inserted as described above, the outer wall 216 of the sill corner bracket is flush with the outer surface of the side wall 36 of the sill plate, while the other outer wall 218 of the sill corner bracket is flush with the outer surface of the side wall 36 of the other sill plate.

Each wall 216 and 218 includes a top side from which a vertical insert 228 extends. The inserts 228 are offset from the plane of the walls and serve as the means for connecting the corner section 214 to the sill corner bracket 212.

As can be seen in FIGS. 13 and 15, the corner section 214 comprises a corner plate 230 and a corner locking plate 232. The corner locking plate 232 is identical in construction to the sill locking plate and thus its component portions are numbered the same as are the corresponding portions of the sill locking plate. The corner plate 230 is a three-sided or generally C-shaped member similar to the sill plate 28 and comprises two perpendicular outer walls 234 and 236. Wall 234 includes a long tab 238 projecting normally therefrom. The free edge of the other wall 236 is bent back over itself into a generally rectangular shape to form a short, thick ledge 240. The ledge 240 is hollow and terminates at its end at an inward extending stop 242.

The corner locking plate 232 is connected to the corner plate 230 to form the corner section by inserting the ledge 240 of the sill plate into the space between the free edge tabs 54 and 56 of the corner locking plate, such that the tab 56 abuts stop 242 and the bridging section 52 abuts an end portion of the long tab 238.

As can be seen in FIGS. 13 and 15, the long wall 46 of a half-stud 27 supporting one wall panel 92 is immediately adjacent to the long tab 238 of the corner plate with a T-shaped vinyl separator 58 interposed therebetween. The long tab 238 includes slot 74 therein to enable rotatable clamps 68 to be inserted therein and through aligned slots in the half-stud 27 to secure the half-stud to the corner section. Similarly, the long wall of the half-stud 27 supporting the mutually perpendicular wall panel 92 is disposed immediately adjacent to the long wall 46 of the corner locking plate 232 with a T-shaped vinyl separator 58 interposed therebetween. Rotatable clamps are inserted in aligned slots in the half-stud and corner locking plate to secure the half-stud to the corner section.

The corner section 214 is connected to the corner bracket by inserting the vertical inserts 228 of the latter into the corner plate 230 of the former. For example, as can be seen in FIG. 14, one vertical insert 228 is adapted to be frictionally disposed within the corner plate 230 and abutting the inner surface of wall 236. The other insert 228 is also adapted to be frictionally disposed within the corner plate 230 but abutting the inner surface of wall 234. The inserts 228 are offset from the plane of the walls from which they extend by the same distance that the flanged insert 224 is offset from the wall from which it extends, such that the walls 216 and 218 of the sill corner bracket are flush with the walls 236 and 234, respectively, of the corner plate 230.

As should be appreciated from the foregoing description, the foundation assemblies in accordance with this invention are relatively simple and inexpensive, can be fabricated when needed and can be readily assembled and locked in place utilizing simple clips without skilled labor and without special tools. All of the above features make the foundation assemblies ideal building components for producing low cost, yet attractive buildings of various overall designs.

Without further elaboration, the foregoing will so fully illustrate our invention that others may, by applying current or future knowledge, readily adapt the same for use under various conditions of service.

What is claimed as the invention is:

1. A foundation assembly for a building including a concrete foundation and a vertical wall panel having an edge, said assembly comprising a sill plate and a sill locking plate mounted on the sill plate, said sill locking plate comprising a first longer wall and a second shorter wall, said walls running generally parallel to one another and connected by a bridging section, each wall terminating in a free edge tab which defines a space therebetween, said sill plate comprising a base having a first and a second wall projecting upward therefrom, said first wall including a portion disposed between said free edge tabs of the sill locking plate and supporting said sill locking plate thereon, said second wall abutting a portion of the short wall of said sill locking plate and supporting said sill locking plate thereon, securement means for mounting said sill plate directly on said foundation and for securing it in place and a wall plate connected to said sill locking plate by rotating clamp means, said wall plate comprising a first longer wall disposed generally parallel to and immediately adjacent said first longer wall of sill locking plate and a second shorter wall, the first and second walls running generally parallel to one another and connected by a bridging section, each wall terminating in a vertical free edge tab which defines a space therebetween into which the edge of a vertical wall panel is disposed.

2. The assembly of claim 1 additionally comprising a stud-tie plate including a base portion interposed between the sill locking plate and the wall plate and a vertically extending flange, said flange being adapted to be connected to a vertically disposed wall stud.

3. A foundation assembly for a building including a concrete foundation and a vertical wall panel having an edge, said assembly comprising sill means mounted directly on and connected to said concrete foundation and a wall plate connected to said sill means, said sill means including a sill plate and a sill locking plate, said wall plate comprising a first longer wall disposed generally parallel to and immediately adjacent said sill locking plate and a second shorter wall, the first and second walls running generally parallel to one another and connected by a bridging section, each wall terminating in a vertical free edge tab which defines a space therebetween into which the edge of a vertical wall panel is disposed, said sill locking plate comprising a first longer wall and a second shorter wall, the first and second walls running generally parallel to one another and connected by a bridging section, each wall terminating in a free edge tab defining a space therebetween and wherein said sill plate comprises a first and second vertical wall projecting from a base, said first wall terminating in a short and thick ledge which is disposed within the space defined by the free edge tabs of the sill locking plate and said second wall terminating in a normally projecting tab abutting a portion of the shorter wall of the sill locking plate.

4. The assembly of claim 3 wherein said longer walls of said sill locking plate and said wall plate are disposed immediately adjacent to one another and are connected thereto.

5. The assembly of claim 4 wherein a vinyl separator is interposed between the adjacent longer walls of the locking plate and the wall plate.

6. The assembly of claim 5 additionally comprising a stud tie plate including a base portion interposed between the adjacent longer walls of the locking plate and the wall plate and a vertically extending flange, said flange being adapted to be connected to a vertically disposed wall stud.

7. A foundation assembly for a building including a concrete foundation and a vertical wall panel having an edge, said assembly comprising first sill means, second sill means disposed normally to said first sill means and a sill corner bracket for connecting said first sills means to said second sill means, each of said sill means comprising a sill plate having a first wall, and a sill locking plate mounted on said sill plate, securment means for mounting said sill plate directly on said foundation and for securing it in place and a wall plate connected to said sill locking plate by rotating clamp means, said wall plate comprising a first longer wall disposed generally parallel to and immediately adjacent said first longer wall of said sill locking plate and a second shorter wall, the first and second walls running generally parallel to one another and connected by a bridging section, each wall terminating in a vertical free edge tab which defines a space therebetween into which the edge of a vertical wall panel is disposed, said sill corner bracket includes a first wall portion and a perpendicular second wall portion, said first wall portion terminating at one side thereof in an offset flanged insert for insertion in and frictional engagement within the sill plate of the first sill means such that the first wall of the sill corner bracket is flush with the first wall of the first sill mean's sill plate, said second wall portion of the sill corner bracket terminating at one side thereof in an offset flanged insert for insertion in and frictional engagement with the sill plate of the second sill means such that the second wall of the sill corner bracket is flush with the first wall of the second sill mean's sill plate, said first and second wall portions of the sill corner bracket terminating at their upper edge in offset flanged inserts for insertion in and frictional engagement within a corner section, said corner section being disposed vertically and comprising a corner plate having two perpendicular outer walls, one of said walls including a long tab projecting inward normally therefrom, the other of said walls including a short and thick ledge projecting inward normally therefrom, and a corner locking plate, the corner locking plate comprising a first longer wall and a second shorter wall, the first and second walls running generally parallel to one another and connected by a bridging section, each wall terminating in a free edge tab which defines a space therebetween into which the short and thick ledge of the corner plate projects, with the bridging section of the corner locking plate abutting a portion of the long tab of the corner plate.

8. The assembly of claim 7 wherein a first vertical half-stud member is connected to the long tab of the corner plate and wherein a second vertical half-stud member is connected to the long wall of the corner locking plate.

9. The assembly of claim 8 wherein said half-studs each comprise a first longer wall and a second shorter wall, the first and second walls running generally parallel to one another and connected by a bridging section, each wall terminating in a free edge tab.

* * * * *